US007773766B2

(12) United States Patent
Akino

(10) Patent No.: US 7,773,766 B2
(45) Date of Patent: Aug. 10, 2010

(54) CORD BUSH AND CONTROL BOX FOR MICROPHONE

(75) Inventor: Hiroshi Akino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 1289 days.

(21) Appl. No.: 11/287,457

(22) Filed: Nov. 28, 2005

(65) Prior Publication Data

US 2006/0115099 A1 Jun. 1, 2006

(30) Foreign Application Priority Data

Dec. 1, 2004 (JP) ..... 2004-348029

(51) Int. Cl.
*H04R 9/00* (2006.01)
*H01R 11/00* (2006.01)

(52) U.S. Cl. ..... 381/355; 439/502

(58) Field of Classification Search ..... 439/502; 381/111, 113, 150, 355, 364
See application file for complete search history.

(56) References Cited

U.S. PATENT DOCUMENTS 4,959,511 A 9/1990 Lloyd et al.
2001/0008672 A1 * 7/2001 Norvell et al. ..... 428/90

FOREIGN PATENT DOCUMENTS

JP S61-68420 U 5/1986
JP S63-33691 U 3/1988
JP 2002-64891 A 2/2002
JP 2003174713 A * 6/2003
JP 2004-14223 A 1/2004

* cited by examiner

*Primary Examiner*—Brian Ensey
(74) *Attorney, Agent, or Firm*—Manabu Kanesaka

(57) ABSTRACT

The present invention provides a cord bush that makes it possible to reliably inhibit a liquid such as water from running along a cord, the length of which can be adjusted, into a control box through as well as a microphone control box including the cord bush. A first flock layer 33 formed by electrostatically transplanting short fibers is provided along a guide hole 23 in a cord bush 22. This inhibits a liquid from infiltrating into a control box 12 through the gap between an electric cord 15 and a cord bush 22.

5 Claims, 2 Drawing Sheets

CORD BUSH AND CONTROL BOX FOR MICROPHONE

TECHNICAL FIELD

The present invention relates to a cord bush attached to an electric cord outlet in a case in which electric parts are built, and more specifically, to a technique for preventing a liquid such as sweat or water from infiltrating into the case through an electric cord.

BACKGROUND ART

A case in which electric parts are housed is provided with an electric cord outlet out of which various electric cords including a power supply cord and a signal cord are drawn. Normally, a cord bush is attached to the electric cord outlet to protect the part out of which the electric cords are drawn (see, for example, Japanese Utility Model Application Publication No. 3027420).

Tie pin or headset microphones are often used if users, for example, TV announcers and aerobics instructors, need to speak with their hands free. Such microphones are located at the user's mouth so that the user can use his or her hands freely.

In the tie pin or headset microphone, a microphone unit is separated from a control box including a power module and a transmitter. The microphone unit and the control box are electrically connected together via a microphone cord. A two-core shield coated wire is normally used as the microphone cord.

FIG. 2 is a diagram illustrating the relationship between the conventional control box and microphone cord. As shown in FIG. 2, the control box 1 comprises a box-like case 2 in which a power module including a driving circuit and batteries as well as a transmitter for a wireless microphone (neither of the components is shown) are housed. The control box 1 is installed on a pelvic belt or the like.

The case 2 is provided with an outlet 3 through which the microphone cord 6 is drawn out of the case 2. A cord bush 4 is attached to the outlet 3 so as to surround the periphery of the microphone cord 6 to protect the cord 6. The microphone cord 6 is drawn out through a guide hole 5 formed in the cord bush 4. A microphone unit (not shown) is connected to the other end (in FIG. 2, the upper end) of the microphone cord 6.

In general, in the microphone cord 6 of this kind, the cord length between the control box 1 and the microphone unit can be freely adjusted depending on the user's physique.

Thus, in the microphone control box 4, shown in FIG. 2, a gap, which is very small, is created between the cord bush 4 and the microphone cord 6 to enable the length of the microphone cord 6 to be adjusted.

Accordingly, when an aerobic instructor wears the control box 1 on his or her pelvis, sweat may run along the microphone cord 6 and enter the case 2 through the gap between the microphone cord 6 and the cord bush 4. The sweat may thus corrode any of the internal electric circuits or batteries to cause it to malfunction.

To avoid such an inconvenience, a waterproof treatment may be carried out by using an adhesive such as a sealant material to seal the cord bush 4 and microphone cord 6. However, this may preclude the adjustment of the length of the microphone cord.

In view of these problems of the prior art, it is thus an object of the present invention to provide a cord bush and a microphone control box which enable the free adjustment of the length of an electric cord and which can reliably prevent a liquid from infiltrating into the control box along the electric cord.

SUMMARY OF THE INVENTION

To accomplish the object, the present invention provides a cord bush having a guide hole through which an electric cord is guided, the cord bush being provided at an electric cord outlet in an electric part housing case, the cord bush being characterized in that the guide hole is provided with a first flock layer formed by electrostatically transplanting short fibers.

According to the present invention, the first flock layer is provided in the guide hole in the cord bush. A second flock layer contacts the outer periphery of the electric cord to reliably prevent a liquid from running along the cord into a case.

Preferably, an outer periphery of the cord bush including an opening of the guide hole is also provided with a second flock layer formed by electrostatically transplanting short fibers. Thus, the infiltration of the liquid can be more reliably prevented by providing the second flock layer around the outer periphery including the opening of the guide portion.

In a more preferred aspect, at least the first flock layer is subject to a water repellent treatment. If the liquid adheres to either of the flock layers, the flock layer reliably repels the liquid to prevent its infiltration because the flock layers are subjected to the water repellent treatment.

The present invention includes a microphone control box using the cord bush. The control box includes a case in which an electric part is housed and a microphone cord having one end connected to an electric part in the case and the other end connected to a microphone unit provided outside the case. The cord bush according to any of the first to third aspects of the invention is provided at an outlet for the microphone cord in the case so that the microphone cord can be drawn out while keeping in contact with the first flock layer.

Even if the control box allows the length of the microphone cord to be adjusted, the above configuration makes it possible to reliably prevent the liquid from infiltrating into the box.

Further, preferably, the microphone unit is a condenser microphone unit, and the control box includes a power module and/or a transmitter. This enables the internal power module and transmitter to be used for a long time without being corroded by a liquid such as sweat.

DETAILED DESCRIPTION

Figure 1:
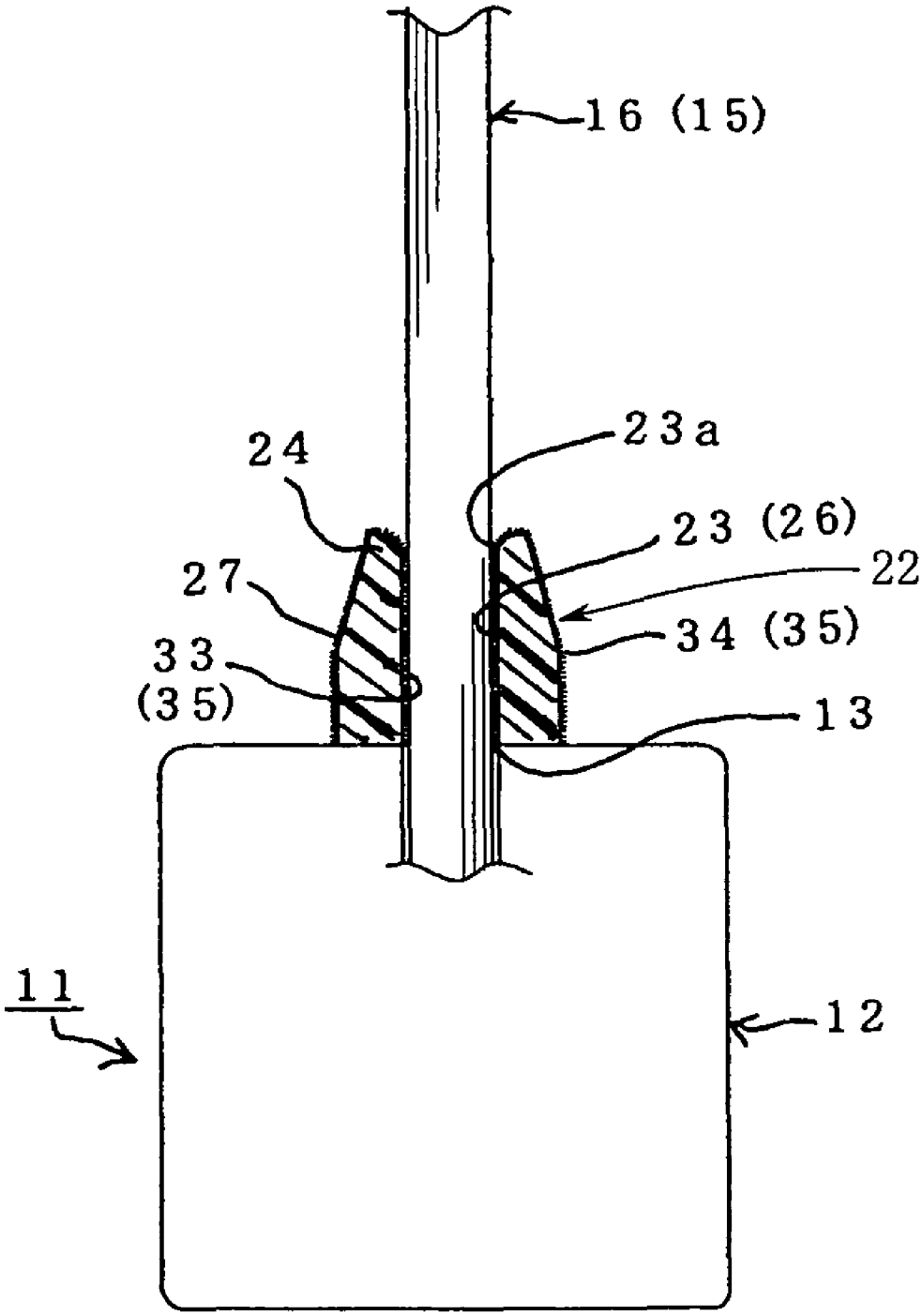
FIG. 1 is a schematic diagram of a control box comprising a cord bush in accordance with an embodiment of the present invention.
Figure 2:
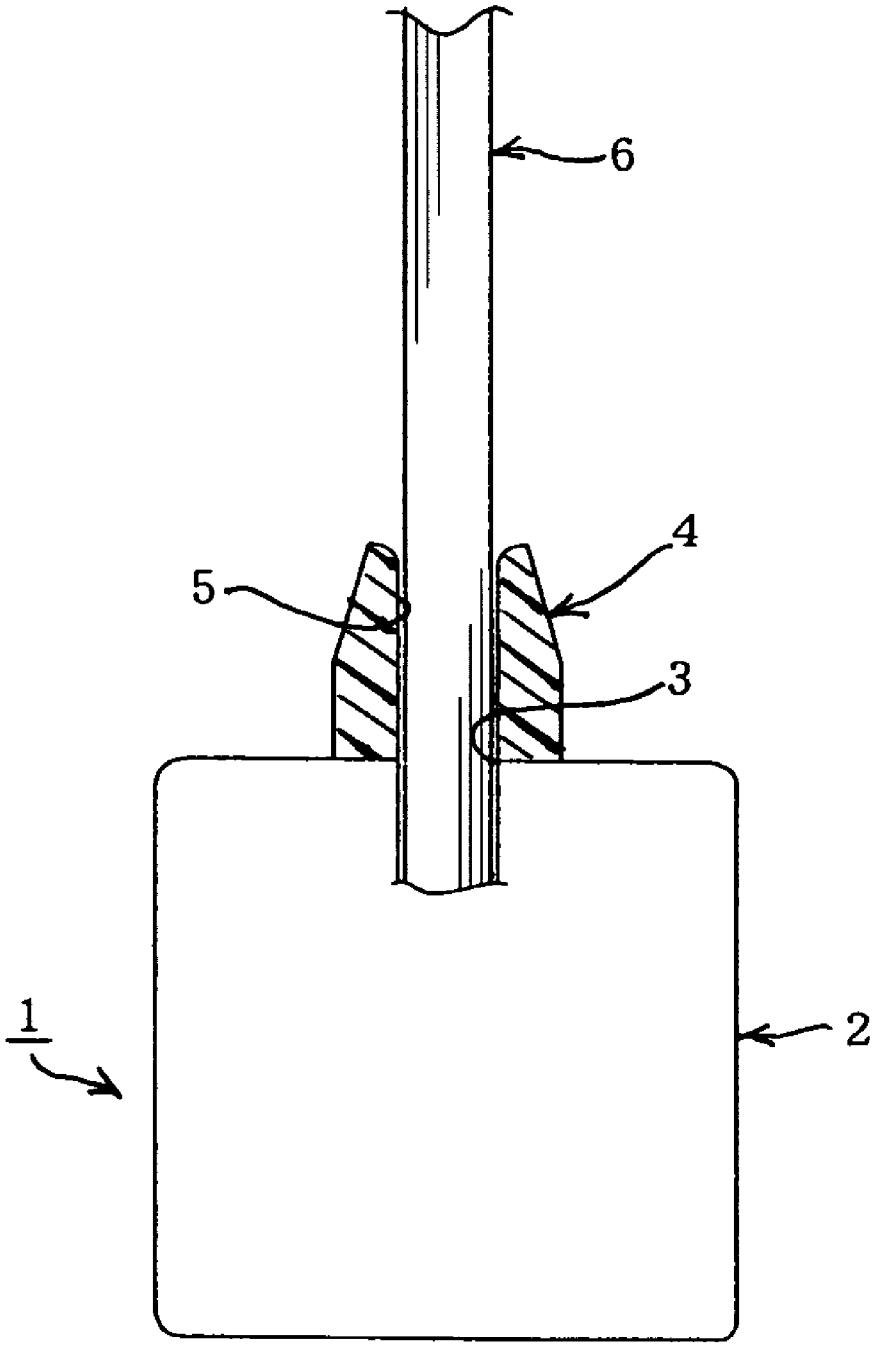
FIG. 2 PRIOR ART
FIG. 2 is a schematic diagram of a conventional control box comprising a cord bush.

FIG. 1 is a schematic diagram of a microphone control box comprising a cord bush in accordance with an embodiment of the present invention. A microphone control box 11 (simply referred to as a control box 11 below) comprises a case 12 in which a power module and a wireless microphone transmitter (neither of these components is shown) are housed; the power module includes batteries and a driving circuit.

In this example, the control box 11 is a control box used for tie pin microphones or headset microphones.

The control box 11 is provided with a microphone cord 16 having one end connected to an internal electric part (not shown) and the other end connected to a microphone unit (not shown) provided outside the control box 11.

The microphone cord 16 is an electric cord 15 in which a signal wire and an electric wire are wired; sound signals from the microphone unit are transmitted through the signal wire, and the electric wire is used to supply power. The outer periphery of the microphone cord 16 is coated with a synthetic resin. Specifications for the microphone cord 16 are arbitrary according to the present invention.

The microphone cord 16 is adapted to appropriately adjust the length between the control box 11 and the microphone unit depending on a user's physique.

Thus, an outlet 13 is formed at a predetermined position of the case 12 so that the microphone cord 16 can be freely advanced and retracted through the outlet 13. The outlet 13 consists of an opening with a diameter larger than that of the microphone cord 16. A cord bush 22 is integrated with the outlet 13 to protect the part out of which the microphone cord 16 is drawn.

The cord bush 22 consists of a molding of a soft material such as rubber. The cord bush 22 is fitted into the outlet 13. A guide hole 23 is formed in the cord bush 22; the guide hole 23 is in communication with the outlet 13 and the microphone cord 16 is guided through the guide hole 23 toward the exterior of the case 12.

The guide hole 23 has a slightly larger diameter than the microphone cord 16. A very small gap is created between the guide hole 23 and the microphone cord 16 so as to enable the microphone cord 16 to be drawn out.

A first flock layer 33 is provided on an inner peripheral surface of the guide hole 23; the first flock layer 33 is obtained by electrostatically transplanting a large number of short fibers 35 so that the fibers are densely upright. In this example, the first flock layer 33 consists of the electrostatically transplanted short fibers 35. However, the first flock layer 33 may be, for example, a felt cloth. The first flock layer 33 has only to be fibers that can contact an outer surface of the microphone cord 16.

Preferably, the cord bush 22 further has a second flock layer 34 provided on the outer peripheral surface 27 of the guide hole 23 including an upper end opening 23*a*. The second flock layer 34 also consists of a large number of electrostatically transplanted short fibers 35. However, like the first flock layer 33, the second flock layer 34 may be composed of other fibrous matter.

With this configuration, the microphone cord 16 is drawn out while keeping in contact with the short fibers 35 of the first flock layer 33. If a liquid such as water adheres to the upper end opening 23*a*, the short fibers 35 would repel it. This would enable the liquid to be prevented from infiltrating into the case 12.

In a more preferred aspect, the short fibers 35 are subjected to a water repellent treatment (waterproof treatment). A commercially available waterproof spray may be used for the water repellent treatment. However, any other method for exerting a water repellent effect may be selected in accordance with the specifications. This makes it possible to reliably repel a liquid adhering to the short fibers 35, thus improving the waterproof effect.

The present invention has been described on the basis of the illustrated example and specific embodiments of the present invention are not limited to this. For example, the shape and size of the case 12 and cord bush 22 may correspond appropriately to the shape or the like of the electric cord 15.

The cord bush 22 in accordance with the present invention may be used not only for the microphone cord 16 but also for an earphone cord attached to, for example, a small-sized radio or a headphone so that the cord can be drawn out of the radio or headphone, provided that the length of the cord from the case 12 can be adjusted.

Moreover, in this example, the first flock layer 33 and second flock layer 34 are formed contiguous to the cord bush 22. However, the first flock layer 33 and second flock layer 34 may be formed on an inner surface 26 of the guide hole 23 which is located near a tip portion 24 of the cord bush 22 as required. Moreover, each flock layer may be formed without being particularly subjected to a water repellent treatment. In this case, the short fibers are desirably composed of a material that appropriately repels water.

The present application is based on, and claims priority from, Japanese Application Serial Number JP2004-348029, filed Dec. 1, 2004, the disclosure of which is hereby incorporated by reference herein in its entirety.

The invention claimed is:

1. A cord bush provided at an electric cord outlet in an electric part housing case, said cord bush comprising:

a guide hole through which an electric cord is guided, and a first flock layer formed of short fibers electrostatically transplanted on an inner periphery of the guide hole, the first flock layer contacting the electric cord and preventing water attached onto the electric cord from entering into the housing case through the guide hole.

2. A cord bush having a guide hole through which an electric cord is guided, the cord bush being provided at an electric cord outlet in an electric part housing case, wherein the guide hole is provided with a first flock layer formed by electrostatically transplanting short fibers, and wherein an outer periphery of the cord bush including an opening of the guide hole is also provided with a second flock layer formed by electrostatically transplanting short fibers.

3. The cord bush according to claim 1, wherein at least the first flock layer is subject to a water repellent treatment.

4. A microphone control box comprising:

a case in which an electric part is housed, a microphone cord having one end connected to an electric part in the case and the other end connected to a microphone unit provided outside the case, and a cord bush provided at an outlet for the microphone cord in the case, said cord bush having a guide hole through which the microphone cord is guided, wherein the guide hole is provided with a first flock layer formed by electrostatically transplanting short fibers so that the microphone cord can be drawn out while keeping in contact with the first flock layer.

5. The microphone control box according to claim 4, wherein the microphone unit is a condenser microphone unit, and the control box includes a power module and/or a transmitter.

* * * * *